United States Patent [19]

Gannon et al.

[11] Patent Number: 4,559,490

[45] Date of Patent: Dec. 17, 1985

[54] METHOD FOR MAINTAINING CONSTANT BANDWIDTH OVER A FREQUENCY SPECTRUM IN A DIELECTRIC RESONATOR FILTER

[75] Inventors: Mark A. Gannon, Schaumburg; Francis R. Yester, Jr., Arlington Heights, both of Ill.

[73] Assignee: Motorola, Inc., Schaumburg, Ill.

[21] Appl. No.: 567,433

[22] Filed: Dec. 30, 1983

[51] Int. Cl.[4] ..... H01P 1/208; H01P 1/203; H01P 1/219

[52] U.S. Cl. ..... 333/202; 333/204; 333/208; 333/210

[58] Field of Search ..... 333/202, 204–212, 333/219–235, 245, 246, 248

[56] References Cited

U.S. PATENT DOCUMENTS

| | | | |
|---|---|---|---|
| 3,187,277 | 1/1965 | Wantuch | 333/210 |
| 3,212,034 | 10/1965 | Kaufman et al. | 333/209 |
| 3,443,131 | 5/1969 | Oltman, Jr. | 333/148 X |
| 3,475,642 | 10/1969 | Karp et al. | 333/227 X |
| 3,818,388 | 6/1974 | Hill et al. | 333/210 |
| 3,840,828 | 10/1974 | Linn et al. | 333/204 X |
| 3,973,226 | 8/1976 | Affolter et al. | 333/202 |
| 4,061,992 | 12/1977 | Inokuchi | 333/202 |
| 4,142,164 | 2/1979 | Nishikawa et al. | 333/205 X |
| 4,143,344 | 3/1979 | Nishikawa et al. | 333/202 |
| 4,179,673 | 12/1979 | Nishikawa et al. | 333/204 |
| 4,268,809 | 5/1981 | Makimoto et al. | 333/202 |
| 4,283,697 | 8/1981 | Masuda et al. | 333/202 |
| 4,477,785 | 10/1984 | Atia | 333/219 |

OTHER PUBLICATIONS

Plourde & Chung-Li Ren, "Application of Dielectric Resonators in Microwave Components", IEEE Transactions on Microwave Theory & Techniques, vol. MTT-29, No. 8, Aug. 1981; pp. 754–770.

Cohn, "Microwave Bandpass Filters Containing High-Q Dielectric Resonators", IEEE Transactions on Microwave Theory and Techniques, vol. MTT-6, No. 4, Apr. 1968; pp. 218–227.

*Primary Examiner*—Marvin L. Nussbaum

*Attorney, Agent, or Firm*—F. John Motsinger; Edward M. Roney; James W. Gillman

[57] ABSTRACT

A method and corresponding apparatus for maintaining constant bandwidth over a frequency spectrum in a microwave, dielectric resonator waveguide filter. Bandwidth is determined by the product of the resonant center frequency and the interresonator coupling coefficient. To maintain constant bandwidth while changing center frequency, the interresonator coupling coefficient must be chosen such that it varies inversely with changes in center frequency. The interresonator coupling coefficient is a function of the physical dimensions of the waveguide and the dielectric resonators, the dielectric constant and the spatial location of the resonators within the waveguide. Once the physical and spatial parameters have been established, the center frequency of the filter may be adjusted by altering the thickness of the resonators without changing the filter bandwidth.

15 Claims, 4 Drawing Figures

METHOD FOR MAINTAINING CONSTANT BANDWIDTH OVER A FREQUENCY SPECTRUM IN A DIELECTRIC RESONATOR FILTER

CROSS REFERENCE TO RELATED APPLICATIONS

Filing Date: Dec. 30, 1983.

Ser. No.: 567,437 and 567,438.

A method to achieve a desired bandwidth at a given frequency in a dielectric resonator filter.

A dielectric resonator filter to achieve a desired bandwidth characteristic.

THE FIELD OF INVENTION

The disclosed inventions, herein, are concerned with filter design.

More particularly, these inventions relate to ways of controlling filter bandwidth in coupled dielectric resonator filters.

Specifically, this disclosure illustrates methods and an apparatus for controlling microwave filter bandwidth characteristics by altering the spatial location between resonators and their location with respect to an electromagnetic field.

BACKGROUND OF THE INVENTION

With increasing spectral crowding at lower frequencies, microwave communications have become a variable alternative and present some interesting opportunities. However, microwave communications have their own set of particularized problems that need to be resolved before extensive commercialization of microwave communications can be realized.

Microwave filter design is but one of those problems to be resolved.

More particularly, in microwave communications, where the microwave frequency spectrum must be heavily subdivided, microwave filter design has become particularly troublesome.

Microwave waveguide dielectric resonator filters have been employed to perform bandpass and band reject functions. Ordinarily, a waveguide of rectangular cross section is provided with a dielectric resonator that resonates at a single center frequency as it is excited by the microwave electromagnetic field. The center frequency of the filter can be set in various ways. The center frequency can be changed by introducing a disturbance in the electromagnetic field about the dielectric resonator or by altering the mass of the resonator.

The response characteristic of the filter can be altered by introducing a number of dielectric resonators in proximity with each other such that the radiated energy coupled from one resonator to the next alters the bandwidth of the filter. It is well known that the bandwidth of a filter is a function of the product of the resonant frequency of the filter and the interresonator coupling coefficient-a coefficient of the energy coupled between resonators. In dielectric resonator filters, the interresonator coupling coefficient can be changed in a variety of ways.

In an evanescent mode waveguide (a waveguide below cut off), dielectric resonators are usually cascaded at the cross sectional center line in a rectangular waveguide (i.e. at the electromagnetic field maxima). To achieve a certain, desired bandwidth, the resonators are longitudinally spaced to provide the desired interresonator coupling. Since the bandwidth is a function of both interresonator coupling and center frequency, a different spacing between resonators (interresonator spacing) is required for each center frequency to maintain the desired filter bandwidth. Accordingly, the cumulative filter length is different for each and every center frequency. Therefore, heavy subdivision of a frequency spectrum results in a multiplicity of filter lengths, corresponding component parts, and manufacturing fixtures.

To eliminate the multiplicity of filter lengths required to service any frequency spectrum, tuning devices were injected to disrupt the energy coupled between resonators (interresonator coupling), thereby providing a tunable bandwidth. However, tuning could only be performed over a relatively small range of frequencies. Also, in multiple pole filters, tuning became an extremely sensitive and laborious task due to the large number of bidirectional and cumulative interresonator couplings and the interaction with the multiple tuning devices.

One of the inventions, presented herein, solves the tuning problem by fixing the interresonator spacing and altering the interresonator coupling coefficient by simultaneously adjusting the position at which the resonators intercept the electromagnetic field distributed across the waveguide cross section.

Another invention, presented herein, solves the tuning and multiple length problem by determining the combination of interresonator spacing and electromagnetic field interception positioning such that changes in interresonator coupling are inversely proportional to changes in center resonant frequency. This inverse proportionality compensates for frequency changes such that filter bandwidth remains constant over the entire frequency spectrum of interest.

This invention represents a significant advance over the prior art and over this technical field by providing a single filter structure that can be utilized throughout the frequency spectrum of interest without resorting to extensive tuning, but remains substantially set to the proper bandwidth whenever the center frequency is changed.

BRIEF SUMMARY OF THE INVENTION

It is the object of the present invention to provide a simple dielectric resonator filter structure that may be easily set to the proper resonant frequency and a method for simply arriving at the desired bandwidth.

One of the instant inventions provides a way of arriving at the desired bandwidth once the interresonator spacing has been established. However, this invention is limited in that the desired bandwidth can only be achieved at a single center frequency.

The ultimate object of the present invention is to provide a single structure that requires little or no tuning of the bandwidth and which remains constant over the entire frequency spectrum such that the structure need only be set to the proper resonant frequency and provides a method to design such a structure.

In accordance with another of the present inventions there is provided a method and a corresponding apparatus for maintaining constant bandwidth over a frequency spectrum in a microwave, dielectric resonator waveguide filter.

Bandwidth is determined by the product of the resonant center frequency and the interresonator coupling coefficient. To maintain constant bandwidth while changing center frequency, the interresonator coupling coefficient must be made to vary inversely with center frequency changes. The interresonator coupling coefficient has been found to vary depending upon the interresonator spacing as well as the position at which the resonators intercept the electromagnetic field distributed across the waveguide.

This invention establishes the proper combination of field-intercepting position and interresonator spacing such that constant bandwidth is maintained over the frequency spectrum of interest.

Using either of the aforementioned filter design methods results in a final filter structure that is common to both methods. The structure consists of a waveguide having a substrate with dielectric resonators thereon for simultaneously positioning the resonators with respect to the electromagnetic field.

BRIEF DESCRIPTION OF THE DRAWINGS

Additional objects, features, and advantages in accordance with the present inventions will be more clearly understood by way of unrestricted example from the following detailed description taken together with the accompanying drawings in which.

The inventions will be readily appreciated by reference to the detailed description when considered in conjunction with the accompanying drawings in which like reference numerals designate like parts throughout the figures.

THE DESCRIPTION OF THE PREFERRED EMBODIMENT

Figure 1:
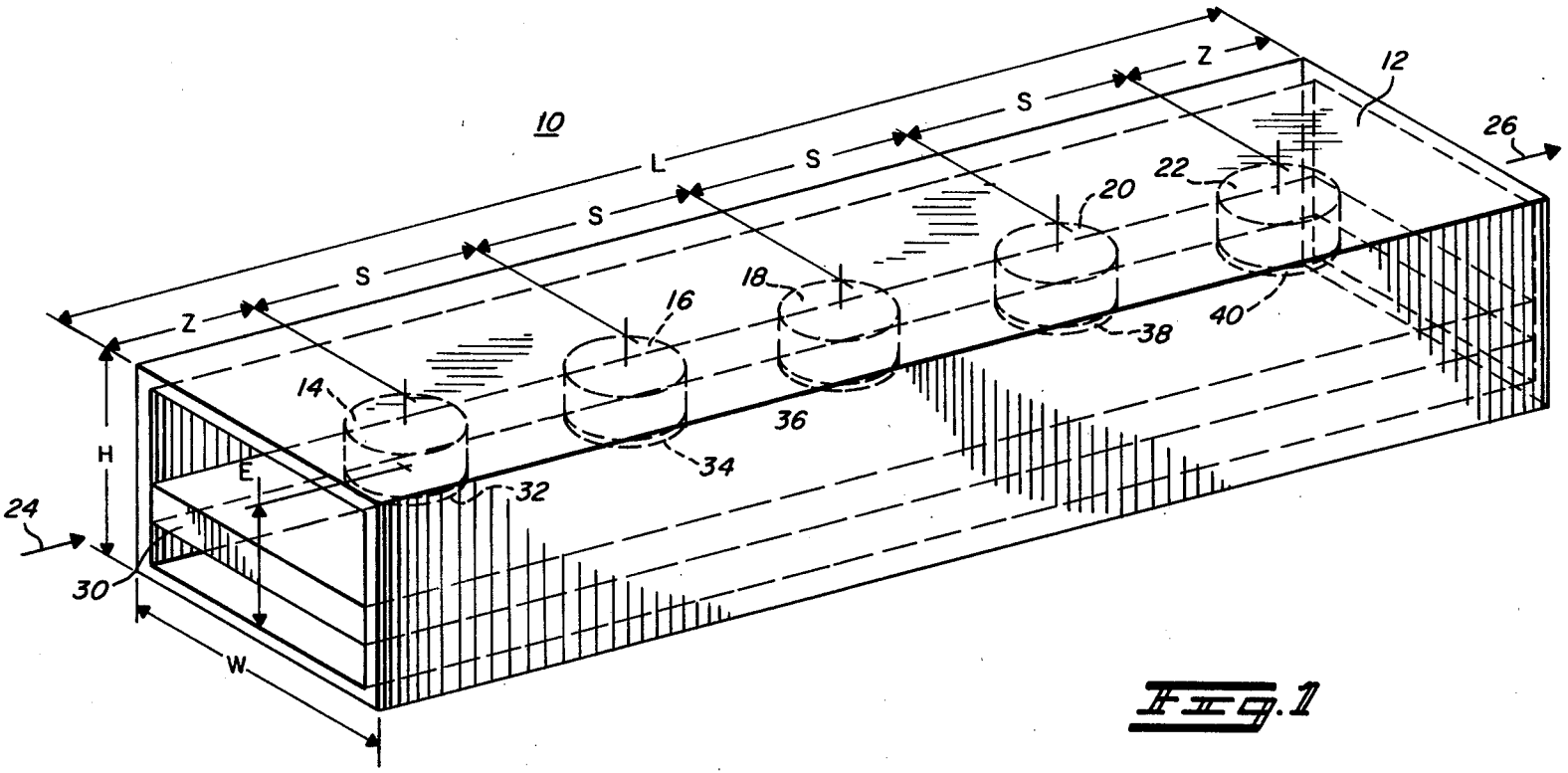
FIG. 1 is a perspective illustration of a five-pole dielectric resonator microwave bandpass filter which incorporates the preferred embodiment of the present invention.

FIG. 1 illustrates the preferred embodiment of a five-pole dielectric resonator waveguide bandpass filter, generally designated 10, which incorporates the present invention.

In the preferred embodiment, the transmission medium 12 for the electromagnetic field to be filtered is a waveguide 12 of rectangular cross section operating in the evanescent mode (i.e., below cut off). In accordance with known methodology, the height H and width W of the waveguide are chosen such that the waveguide will cut off all frequencies below a certain level, yet allow higher frequencies to propagate through the waveguide 12. The ratio of the width W to the height H is chosen to properly orient the electric and magnetic components of the electromagnetic field. In the preferred embodiment illustrated in FIG. 1, the height H and width W are chosen such that H is smaller than W so that the magnetic field is distributed across the height H while the electric field is distributed across the width W. The height H and width W are also chosen so as not to substantially interfere with the quality factor Q of the dielectric resonators 14–22. To avoid interfering with the resonator quality factor Q, the height H is chosen to be 3–4 times the resonator thickness T and the width W is chosen to be 2–3 times the resonator diameter D.

The length L of the waveguide 12 is determined by the sum of the interresonator spacings S and the proper spacing Z for coupling to the entry 24 and exit ports 26. Electromagnetic energy may be introduced at the entry port 24 of the waveguide filter 10 by an appropriate waveguide transition (not shown) or by microstrip 28 brought in close proximity to the first dielectric resonator 14. Similarly, electromagnetic energy may be extracted from the filter 10 by an appropriate waveguide transition (not shown) or by microstrip (not shown) brought in close proximity to the last dielectric resonator 22 at the exit port 26.

In the preferred embodiment, the rectagular waveguide 12 is provided with a resonator mounting substrate 30 having a low dielectric constant. The mounting substrate 30 is vertically adjustable such that the position E of the dielectric resonators 14–22 can be adjusted with respect to the magnetic field distributed across the waveguide 12 height H. After the proper vertical elevation E has been established, to provide the desired bandwidth of the filter 10, the substrate 30 may be mechanically fastened or bonded in place. The substrate 30 is useful, though not absolutely necessary, for simultaneously adjusting the vertical elevation E of all the dielectric resonators 14–22.

The dielectric resonators 14–22 may be mounted directly upon the substrate 30. However, for ease of vertical adjustment, while the filter 10 design is being refined (as described below), precision pedestals 32–40, having a relatively low dielectric constant are highly recommended. Similarly, pedestals 32–40 having shim thickness can be employed for fine tuning in the mass production of the filter 10.

In the preferred embodiment, the resonator discs 14–22, configured in a horizontal cascade has been chosen for ease of frequency adjusting. The dielectric resonators 14–22, excited by electromagnetic energy will resonate at one frequency, determined by their individual mass. Advantageously, the resonant frequency of each resonator 14–22 and, therefore, the center frequency of the entire filter 10 can be altered by merely simultaneously altering the thickness T of the resonators 14–22. Having the resonators 14–22 commonly mounted upon the substrate 30 greatly facilitates this operation.

The diameter D and thickness T of the dielectric resonators 14–22 are chosen so that they resonate in their fundamental mode at the desired resonant frequency and such that higher order modes are minimized. A diameter D to thickness T ratio (D/T) of 2–3 has proved to be particularly advantageous.

The dielectric resonators 14–22 receive electromagnetic energy from the entry port 24, are excited to resonate at one frequency, and, in turn, radiate energy at the resonant frequency. The energy dies off exponentially with the distance S from each resonator 14. If a second resonator 16–22 is brought close enough to the energy radiated by the first resonator 14, the second resonator 16–22 will be excited to resonate also. The second resonator 16–22, in turn, will re-radiate energy in all directions, coacting to excite the first 14 and third 18 resonators. This interresonator coupling is responsible for altering the response characteristic of a single dielectric resonator 14 to achieve wider and sharper bandwidth characteristic. Accordingly, only a certain range of frequencies will be supported in the waveguide filter. The amount of energy intercepted by the second resonator 16–22 is a function of its distance S from the first resonator 14 and the amount of energy intercepted at its position E along the magnetic field distribution. Accordingly, the bandwidth of the filter can be controlled by judiciously choosing the interresonator spacing S as well as the transverse positioning E of the resonators 14–22 with respect to the electromagnetic field distribution.

Thus, since bandwidth is a function of the vertical E and lateral S positioning of the resonators 14–22; within limits, one variable may be fixed while the other is adjusted to achieve the desired bandwidth.

Accordingly, in this first invention, the filter 10 can be tuned to the proper bandwidth by selecting an interresonator spacing S to provide a sufficient amount of interresonator coupling and then arriving at the desired bandwidth by adjusting the elevation E at which the resonators intercept the magnetic field distribution. This structure and method of achieving the desired bandwidth greatly facilitates what had been heretofore a laborious process of mechanically tuning the interresonator couplings by disturbing the interresonator energy.

However, this first invention has a limitation in that each center frequency requires a different combination of interresonator spacing S and vertical elevation E.

In filter design, it is well known that bandwidth is a function of the product of the interresonator coupling coefficient and the center frequency. If the interresonator coupling coefficient can be made to vary inversely with center frequency changes, one single structure could be utilized over an entire frequency spectrum while maintaining constant bandwidth. That is the subject of the next invention.

This next invention utilizes the same structure as presented in the earlier implementation, but presents a method for converging upon the proper combination of interresonator spacing S and vertical elevation E that will allow the interresonator coupling coefficient to vary inversely with center frequency changes.

The method is as follows:

Select an appropriate bandwidth (dictated by the conditions of each particular application). Choose a set of discrete frequencies within the frequency spectrum of interest. For each frequency, fabricate a set of dielectric resonators 14–22 of corresponding thickness T. Begin the converging process with a resonator thickness T representing a frequency in the center of the spectrum.

Set the vertical elevation E of the resonators at some point less than the field strength maximum (H/2) to allow an adjustment range whereby the intercepted field strength may be increased. A set of precision machined pedestals 32–40, having a low dielectric constant will prove highly advantageous for adjusting the vertical elevation E.

Knowing the center resonant frequency of the resonator 14–22 being tested, knowing the desired bandwidth, and knowing that bandwidth is the product of center resonant frequency and interresonator coupling, calculate the required interresonator coupling coefficient. Then, the interresonator spacing S may be set by measuring and monitoring the interresonator coupling coefficient while altering the spacing S. This first combination of parameters is but one combination of center frequency, interresonator spacing S and vertical elevation E that yields the desired bandwidth.

Figure 4:
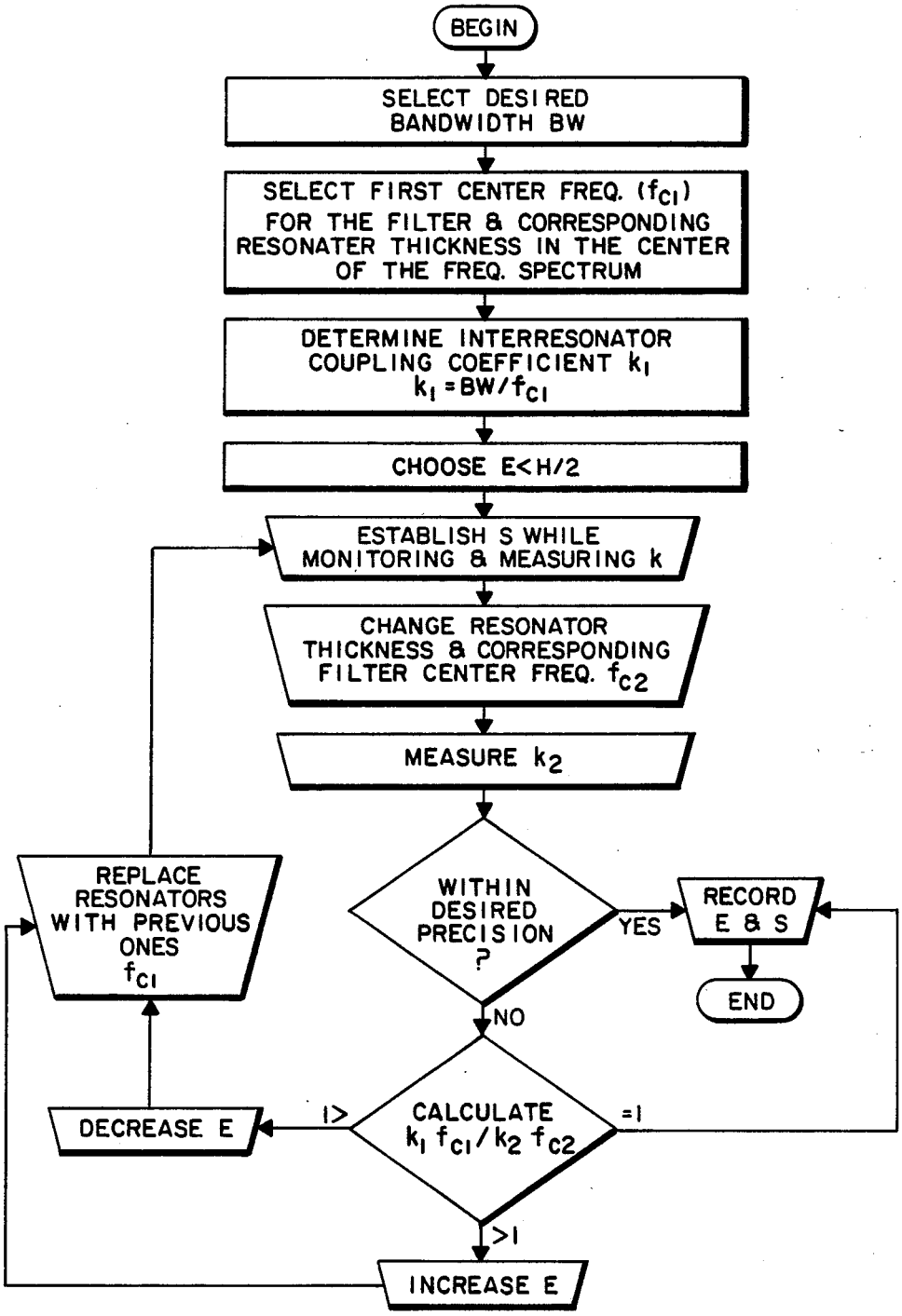
FIG. 4 is a flow chart illustrating the methodology for converging upon the proper combination of interresonator spacing and electromagnetic field interception position according to the invention.

Next, change the center resonant frequency of the filter by exchanging the current resonators 14–22 with those of a different frequency, by shaving the thickness T of the current resonators 14–22 thereby altering their mass, or preferrably, by interchanging the current resonators with those of a different prefabricated thickness. Observe whether the rate of change of interresonator coupling has changed more quickly or more slowly than the change in frequency by measuring the new interresonator coupling coefficient. The rate of coupling change can then be altered by moving toward or away from the field strength maxima (H/2) or widening or narrowing the interresonator spacing S. FIG. 4 illustrates the methodology for determining the appropriate adjustment.

Through successive iterations of changing frequency, measuring the interresonator coupling coefficient, and altering the spacial relationship of the resonators, one will converge upon the point at which the interresonator spacing S and the vertical elevation E become fixed for all center frequencies. (FIG. 4 illustrates the converging methodology). It is at this point that the interresonator coupling coefficient is inversely proportional to changes in center frequency. Accordingly, this final position (S, E) establishes the filter design parameters for maintaining constant bandwidth over the entire frequency spectrum.

The following parameters were found using the method of the instant invention in the preferred embodiment of FIG. 1:

| | Parameter | Value |
|---|---|---|
| Waveguide: | | |
| | Height (H) | 0.55 inches |
| | Width (W) | 0.75 inches |
| | Length (L) | 4.75 inches |
| | Dielectric Constant | 1 |
| Dielectric Resonator: | | |
| | Diameter (D) | 0.335 inches |
| | Thickness (T) | 0.104–0.146 inches |
| | Dielectric Constant | 37 |
| Pedestal: | | |
| | Diameter (D) | 0.335 inches |
| | Thickness | 0.106 inches |
| | Dielectric Constant | 1 |
| Frequency Spectrum: | | 6.4–7.2 GHz |
| Bandwidth: | | 70 MHz |
| Interresonator Spacing (S): | | 0.8014 inches |
| Dielectric Elevation (E) | | 0.106 inches |

Thus, there has been provided a simple dielectric resonator filter structure that may be easily set to the desired resonant frequency and a method for simply arriving at the desired bandwidth.

Further, there has been provided a single structure that requires little or no tuning of the bandwidth, which remains constant over the entire frequency spectrum, such that the structure need only be set to the proper resonant frequency and there has been provided a method for designing such a structure.

Finally, there has been provided a method and a corresponding apparatus for maintaining constant bandwidth over a frequency spectrum in a microwave, dielectric resonator waveguide filter.

It will be appreciated by those skilled in the art that various transmission means may be used in lieu of the rectangular waveguide 12 including, but not limited to, round waveguide, microstrip 28 and free space. It will further be appreciated that the dielectric resonators 14–22 need not be discs nor in a horizontally cascaded orientation.

Figure 2:
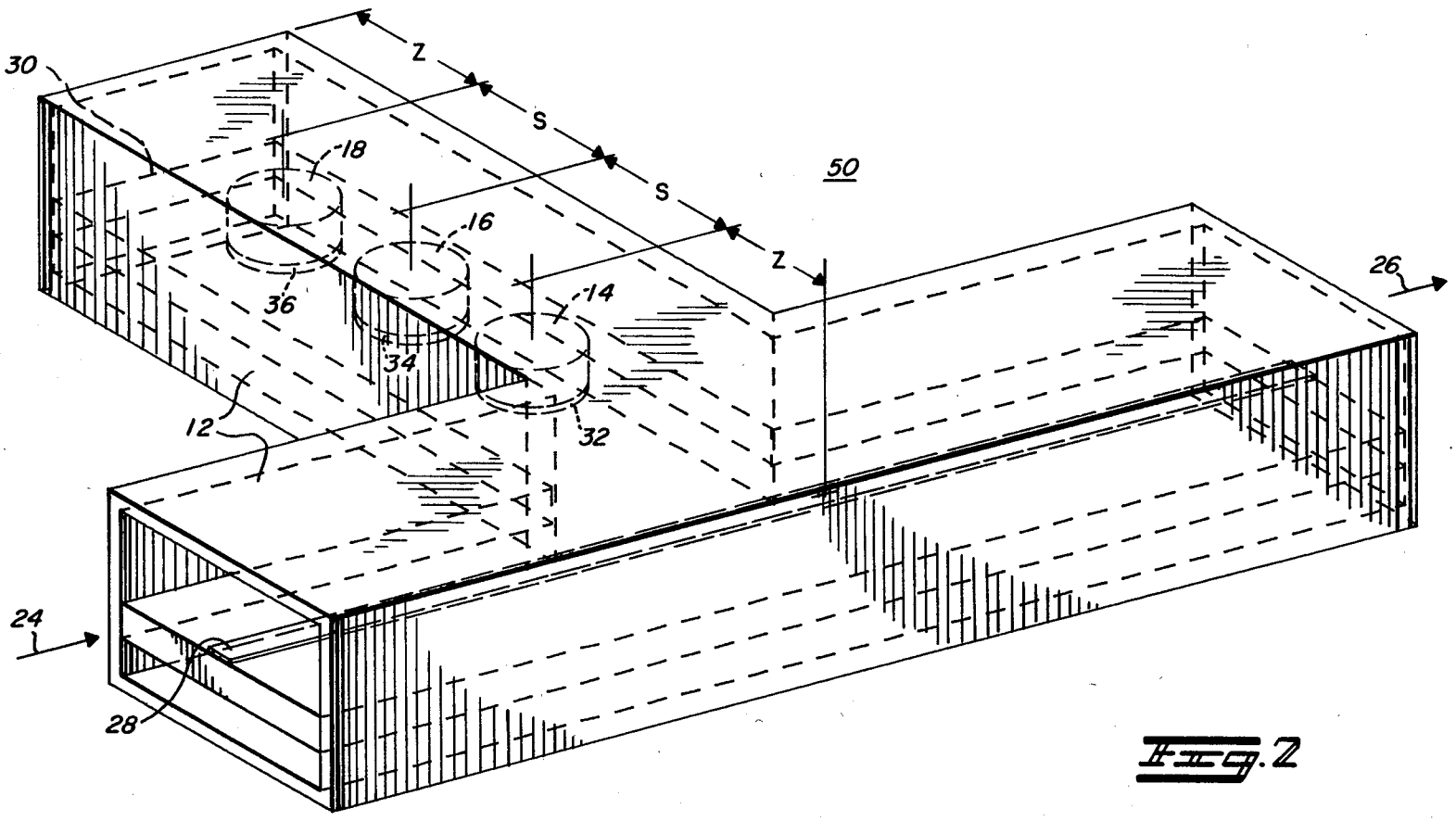
FIG. 2 is a perspective illustration of a three-pole dielectric resonator microwave band elimination filter which incorporates the preferred embodiment of the present invention.

It will further be appreciated that this technique can be applied to a number of filtering situations, for example, as illustrated in FIG. 2, there is illustrated a three-pole dielectric resonator band elimination filter, generally designated 50, whose bandwidth can be controlled as described above.

It will further be appreciated that converging upon the proper interresonator spacings and electromagnetic field intercepting elevation E can be facilitated by statistical modelling and computer simulation. Such a method, using Fortran, has been included in the Appendix.

Figure 3:
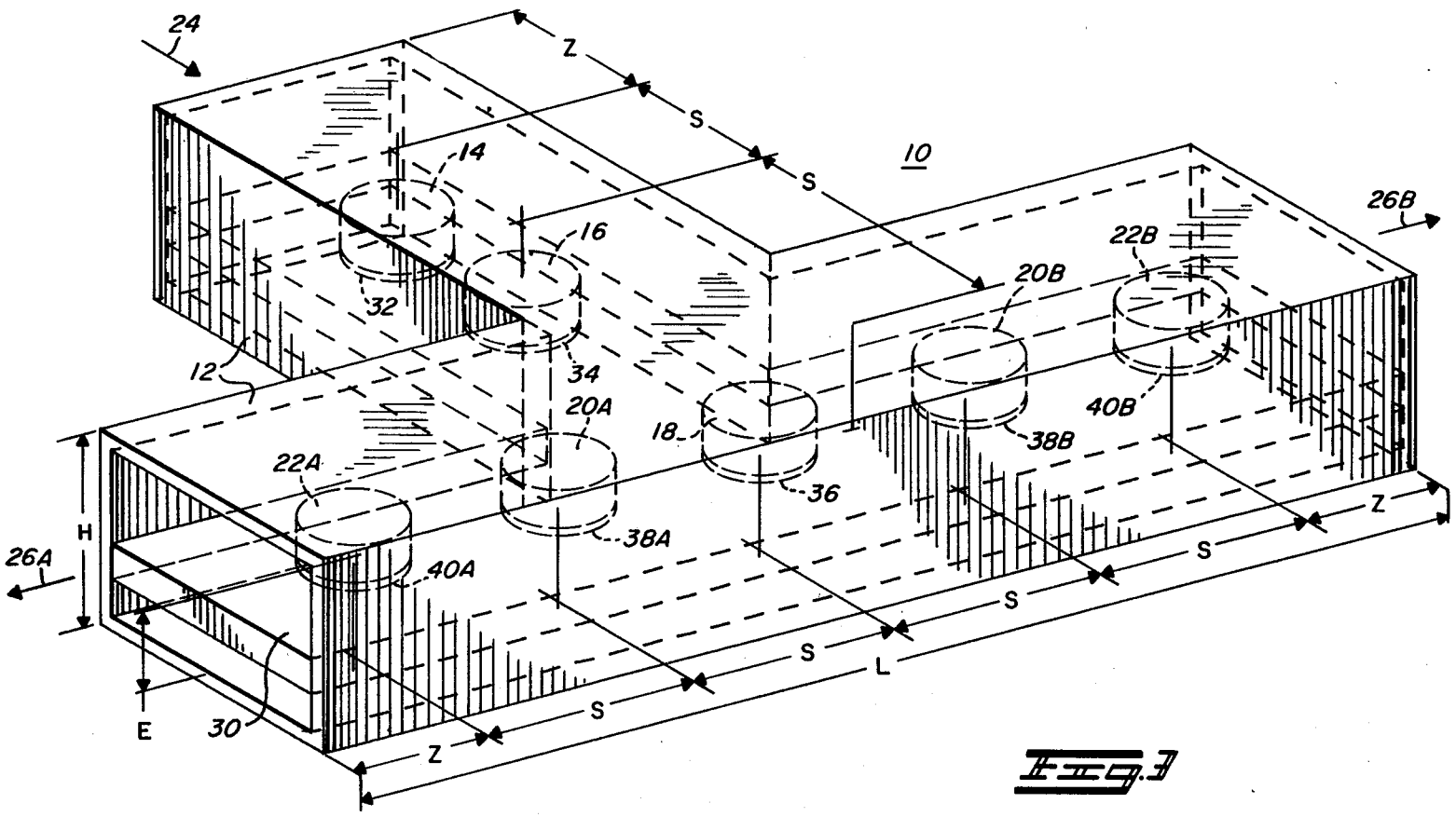
FIG. 3 is a perspective illustration of a three directional five pole filter and power splitter which incorporates the preferred embodiment of the present invention.

FIG. 3 illustrates a three directional five-pole filter 14–22*a* and 14–22*b* and power splitter 18, 20*a* and 20*b* that can utilize the present invention while sacrificing a minor degree of precision due to the reduced power splitting couplings (18–20*a* and 18–20*b*).

The foregoing description of the various embodiments are illustrative of the broad inventive concept comprehended by the invention and has been given for clarity of understanding by way of unrestricted example. However, it is not intended to cover all changes and modifications which do not constitute departures from the spirit and scope of the invention.

APPENDIX

```
REAL KC, M,N,L
WRITE (108,100)
WRITE (108,110)
WRITE (108,110)
COMMON A1, A2,A3,A4,B2,B4,ALPHA, ALPHAS, ALPHAP,
  T1,T2,T3,T4
COMMON KC, PI,L,C,ER,EP,ES,T,P,D,GAMI,F0
A=ENTER ('INPUT WAVEGUIDE HEIGHT ',23)
B=ENTER ('INPUT WAVEGUIDE WIDTH ',22)
T=ENTER ('INPUT SUBSTRATE THICKNESS ',26)
D=ENTER ('INPUT AIR GAP BETWEEN TUNER & D.R. ',35)
R1=ENTER ('INPUT RESONATOR RADIUS ',23)
L=ENTER ('INPUT RESONATOR LENGTH ',23)
ER=ENTER ('INPUT RESONATOR D.C.  ',23)
ES=ENTER ('INPUT SUBSTRATE D.C.  ',23)
EP=ENTER ('INPUT PEDESTAL D.C.  ',21)
P=ENTER ('INPUT PEDESTAL THICKNESS ',26)
DEL=ENTER ('INPUT RES. DELTA ',18)
F0=ENTER ('INPUT FREQ.--IN GHZ ',21)
S1=ENTER ('INPUT STARTING RESONATOR TO RES.
  SPACING',43)
S2=ENTER ('INPUT ENDING RES.-RES. SPACING ',33)
SI=ENTER('INPUT RES.-RES. INCREMENT ',27)
WRITE(108,110)
WRITE(108,110)
WRITE(108,120)
WRITE(108,110)
FO=FO*1E9
```

```
PI=3.14159265359
C=1.1811E10
WAV=C/FO
DEL1=DEL-.0001/(F(DEL+.0001)/F(DEL)-1)
IF(ABS*DEL1-DEL).LT..0001) GO TO 40
DEL=DEL1
GO TO 50
X=ES*(-.5*A1*A1*T+A1*A1/4/ALPHAS*SINH(2*T1))
X=X+EP
*(B2*B2-A2*A2)/2*P+(A2+A2*B2*B2)/4/ALPHAP*SINH(T2*2))
X=X+EP*A2*B2/2/ALPHAP*(COSH(2*T2)-1)
X=X+(B4*B4-A4*A4)/2*(D)+(A4*A4+B4*B4)/4/ALPHA*SINH(2
  *T4)
X=X+A4*B4/2/ALPHA*(COSH(2*T4)-1)ER*(A3*A3+1)/2*L
X=X+ER(1-A3*A3)/2/GAMI*SIN(2*T3)
X1=1/ALPHA*(A4*(COSH(T4)-1)+B4*SINH(T4))
X1=X1+EP/ALPHAP*(A2*(COSH(T2)-1)+B2*SINH(T2))
X1=X1+ES/ALPHAS*A1*(COSH(T1)-1)+2*ER/GAMI*SIN(GAMI*L
  /2)
T9=KC*R1
CALL BESL1(T9,0,T5,1E-5,IE)
CALL BESL1(T9,1,T6,1E-5,IE)
CALL BESL1(T9,2,T7,1E-5,IE)
WM=X*R1*R1*P1/2*8.854E-12/39,37*(T6*T6-T5*T7)
DIPOL E=2*PI*FO*PI*8.854E-12*R1*R1*T7*X1/KC/(39,37**2)
DO 20 S=S1,S2,SI
ANS=0
DO 10 M=1,5,1
DO 30 N=0,4,2
WAVMN=1/SQRT((M/2/A)**2+(N/2/B)**2)
WAVM=2*A/M
ALPHAMN=2*PI/WAVMN*SQRT(1-(WAVMN/WAV)**2)
ALPHA0=2*PI/WAVM*SQRT(1-(WAVM/WAV)**2)
B1=SIN(GAMI*L/2+M*PI*L/2/A)/(M*PI/A+GAMI)
B1=B1+SIN(M*PI*L/2/A-GAMI*L/2)/(M*PI/A-GAMI)
B1=B1*SIN(M*PI/A*(T+P)+M*PI*L/2/A)
B2=SIN(M*PI*L/2/A-GAMI*L/2)/(M*PI/A-GAMI)
B2=B2-SIN(M*PI*L/2/A+GAMI*L/2)/(M*PI/A+GAMI)
```

```
B1=B1+A3*B2*COS(M*PI*(T+P)/A+M*PI*L/2/A)
B1=B1/SIN(GAMI*L/2)
B2=0
Y=2*PI*SQRT((M/2/A)**2-1/WAV**2)
T9=Y*R1
CALL BESL3(T9,0T7,IE)
CALL BESL3(T9,1,T8,IE)
B2=DIPOLE*KC*GAMI*(KC*T7+Y+T8+T5/T6)/2/(Y*Y+KC*KC)
TEM=INT(2.9-1/(N+1))*EXP(-1*ALPHAMN*S)
ANS=ANS+ALPHA0**2/ALPHAMN*B1*B1*B2*B2*TEM
CONTINUE
CONTINUE
ANS=ANS*(4E-7*PI)**2*C/(2*377*WM*A*B)
WRITE(108,80)ANS,S
FORMAT(F15,10,5X,F9.4)
CONTINUE
FORMAT(32HINTER-RESONATOR COUPLING PROGRAM)
FORMAT(1X)
FORMAT(8HCOUPLING,12X,7HSPACING)
WRITE(108,80)DEL,FO
END
REAL FUNCTION COSH(X)
COSH=(EXP(X)+EXP(-1*X))/2
RETURN
END
REAL FUNCTION F(DEL)
COMMON
A1,A2,A3,A4,B2,B4,ALPHA,ALPHAS,ALPHAP,T1,T2T3,T4
COMMON KC,PI,L,C,ER,EP,ES,T,P,D,GAMI,FO
REAL KC,L
GAMI=PI*DEL/L
ALPHA=SQRT((2*PI*FO/C)**2*(ER-1)-GAMI**2)
ALPHAS=SQRT((2*PI*FO/C)**2*(ER-ES)-GAMI**2)
ALPHAP=SQRT((2*PI*FO/C)**2*(ER-EP)-GAMI**2)
KC=SQRT((2*PI*FO/C)**2*ER-GAMI**2)
T1=ALPHAS*T
T2=ALPHAP*P
```

```
T3=PI*DEL/2
T4=ALPHA*D
A3=-1*ALPHA+GAMI*TAN(T3)*TANH(T4)
A3=A3/(ALPHA*TAN(T3)+GAMI*TANH(T4))
A4=-1*GAMI/(ALPHA*SIN(T3)+GAMI*TANH(T4)*COS(T3))
B4=-1*A4*TANH(T4)
A2=A3*(GAMI+ALPHAP*TAN(T3)*TANH(T2))+GAMI*TAN(T3)
A2=A2-ALPAP*TANH(T2)
A2=A2*COS(T3)*COSH(T2)/ALPHAP
B2=A3
*(GAMI*TANH(T2)+ALPHAP*TAN(T3)+GAMI*TAN(T3)*TANH(T2)
B2=B2-ALPHAP
B2=B2*COS(T3)*COSH(T2)/(-1*ALPHAP)
A1=(A2*ALPHAP/ALPHAS/COSH(T1)+B2/SINH(T1))/2
F=A2*ALPHAP/ALPHAS/COSH(T1)-B2/SINH(T1)
RETURN
END
```

What we claim and desire to secure by Letters Patent is:

1. A method of determining the spatial parameters of a plurality of resonators with respect to a propagating electromagnetic field having a maxima in a dielectric resonator filter comprising the steps of:

a. selecting a desired filter bandwidth and determining an interresonator coupling coefficient that produces the desired bandwidth about a center frequency within a frequency spectrum of interest, b. choosing positions for the resonators along the direction of electromagnetic field propagation, c. obtaining the required interresonator coupling by measuring and monitoring the interresonator coupling coefficient while altering the interresonator spacing, d. altering the resonant center frequency of the resonators to some other center frequency within the spectrum of interest, e. moving all of the resonators either toward or away from the electromagnetic field strength maxima or increasing or decreasing the interresonator spacing in proportion to the relative rate of change of the interresonator coupling coefficient as compared with the rate of change of the center frequency, f. iterating steps c–e to the desired degree of precision, whereby successive iterations converge upon a combination of parameters at which changes in center frequency are compensated by changes in interresonator couplings such that constant filter bandwidth is maintained at any filter center frequency throughout the frequency spectrum of interest.

2. A method as claimed in claim 1 wherein the dielectric resonator filter further comprises: a bandpass filter.

3. A method as claimed in claim 2 wherein the dielectric resonator filter further comprises: a waveguide filter.

4. A method as claimed in claim 2 wherein the dielectric resonator filter comprises: a microstrip filter.

5. A method as claimed in claim 2 wherein the dielectric resonator filter further comprises: a microwave filter.

6. A method as claimed in claim 1 wherein the dielectric resonator filter further comprises: a band elimination filter.

7. A method as claimed in claim 6 wherein the dielectric resonator filter further comprises: a waveguide filter.

8. A method as claimed in claim 6 wherein the dielectric resonator filter comprises: a microstrip filter.

9. A method as claimed in claim 6 wherein the dielectric resonator filter further comprises: a microwave filter.

10. A method as claimed in claim 1 wherein iterations are at least partially performed by statistical modelling.

11. A method as claimed in claim 1 wherein iterations are at least partially performed by computer simulation.

12. A method as claimed in claim 1 wherein the electromagnetic field is supported in a transmission medium.

13. A method as claimed in claim 12 wherein the transmission medium is a waveguide.

14. A method as claimed in claim 12 wherein the transmission medium is a microstrip.

15. A method as claimed in claim 12 wherein the transmission medium is free space.

* * * * *